United States Patent [19]

Mitsui et al.

[11] 4,300,131

[45] Nov. 10, 1981

[54] DEVICE FOR INDICATING AN ABNORMAL CONDITION IN AN ULTRASONIC NEBULIZER

[75] Inventors: Sadao Mitsui, Chiba; Minoru Takahashi, Funabashi; Keiichi Watanabe, Ichikawa, all of Japan

[73] Assignee: TDK Electronics Co, Ltd., Tokyo, Japan

[21] Appl. No.: 56,625

[22] Filed: Jul. 11, 1979

[30] Foreign Application Priority Data

Dec. 26, 1978 [JP] Japan ..... 53-176714[U]

[51] Int. Cl.[3] ..... G08B 21/00

[52] U.S. Cl. ..... 340/618; 340/624; 128/207.26; 128/202.22

[58] Field of Search ..... 340/618, 623, 624, 625, 340/652, 662; 128/194

[56] References Cited

U.S. PATENT DOCUMENTS

| | | | |
|---|---|---|---|
| 1,243,470 | 10/1917 | White | 340/624 |
| 2,524,274 | 10/1950 | Samuels | 340/624 |
| 3,242,474 | 3/1966 | Gast et al. | 340/624 |
| 3,253,820 | 5/1966 | Seil | 340/623 |
| 3,412,392 | 11/1968 | Jenkins et al. | 340/662 |
| 3,849,771 | 11/1974 | Applin | 340/624 |
| 3,989,042 | 11/1976 | Mitsui et al. | 128/194 |
| 4,080,828 | 3/1978 | Akita et al. | 340/624 |

*Primary Examiner*—Gerald L. Brigance

[57] ABSTRACT

An alarm for indicating a lack of liquid in an ultrasonic nebulizer is disclosed. The alarm is responsive to a level sensing device in the nebulizer used to terminate oscillation in response to a low liquid level situation.

4 Claims, 3 Drawing Figures

DEVICE FOR INDICATING AN ABNORMAL CONDITION IN AN ULTRASONIC NEBULIZER

BACKGROUND AND BRIEF DESCRIPTION OF THE INVENTION

The present invention relates to an ultrasonic nebulizer, and more particularly to a device for indicating an abnormal condition in the nebulizer such as by generating an alarm signal when the level of liquid in the nebulizer falls below a predetermined level.

It is known to sense liquid level in an ultrasonic nebulizer and to terminate oscillation and consequent nebulizing of the liquid when liquid level falls below a predetermined value (see U.S. Pat. No. 3,989,042). However, there is no means for informing an operator that the liquid is not present in the nebulizing container. Therefore, the operator cannot judge whether the system has been stopped due to an absence of liquid in the container or the system has been shut down due to some other problem. Additionally, there is no signal indicating a need for liquid to be supplied to the system, so that liquid may not be supplied for a long period of time, and the humidity generating function, e.g., of the system will be destroyed. In order to generate an alarm signal showing an absence of liquid, it may be possible to provide an additional float switch and thereby to operate such alarm device as a lamp or buzzer. However, such a prior art system requires an additional float switch, which complicates the entire system and increases the manufacturing cost.

It is thus an object of the present invention to provide an ultrasonic nebulizer in which only one float switch is used, and an alarm signal is generated and the oscillating operation in the circuit is terminated when an absence of liquid is determined.

The present invention finds application in an ultrasonic nebulizer that includes a container for storing a liquid therein, a transducer located substantially at the bottom part of the container to apply an ultrasonic wave to the liquid and to nebulize the same, an oscillator for energizing the transducer, a float switch for sensing the presence of liquid in the container, means for controlling a biasing voltage in the oscillator dependent upon the output at the float switch and terminating oscillation when liquid falls below a certain level in the container, and an alarm means connected to the float switch. The invention involves use of a two-terminal float switch so that when the liquid level in the container falls below that predetermined level, the float switch is released and a biasing current is no longer applied to the oscillator circuit; at the same time an alarm signal is generated.

The invention will be more completely understood by reference to the following detailed description.

DETAILED DESCRIPTION

Figure 1:
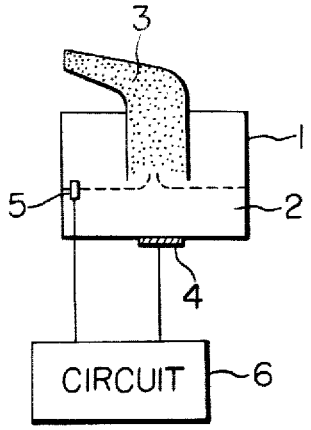
FIG. 1 shows an ultrasonic nebulizer to which the invention is applicable.

FIG. 1 illustrates a practical example of an ultrasonic nebulizer to which the present invention is applicable. A container 1 stores a liquid such as water. A duct 3 guides a fog generated in the container by an ultrasonic transducer 4 installed substantially at the bottom of the container. A float switch 5 is used to sense the presence of the liquid in the container. For example, the switch 5 may be composed of a permanent magnet that is moved up and down in accordance with the water level, and may include a reed switch (not shown). FIG. 1 of U.S. Pat. No. 3,989,042 shows in more detail such a permanent magnet/reed switch device. An electric circuit 6 is included incorporating therein an oscillator which excites the transducer 4. Under the above described arrangement, when the transducer 4 is oscillated in a range of ultrasonic vibration, the liquid 2 such as water is nebulized, and the generated fog is discharged outside of the duct 3 to perform a humidifying operation, e.g. when the transducer 4 is oscillated and there is no water in the container (that is, non-load condition), both the transducer 4 and the electric circuit 6 may be damaged. To prevent damage, the electric circuit 6 acts to automatically stop oscillation when an absence of water in the container is sensed by the float switch 5. Such an operation is disclosed in U.S. Pat. No. 3,989,042.

Figure 2:
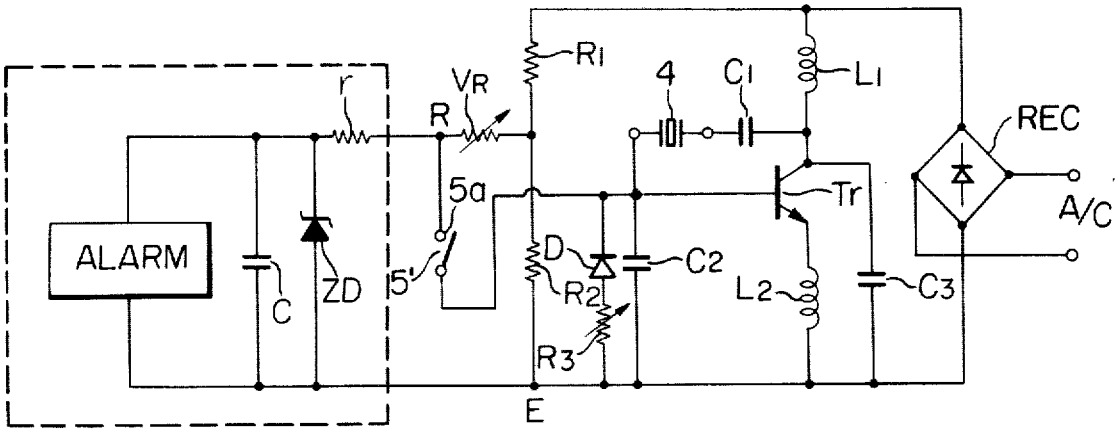
FIG. 2 is a circuit diagram of an ultrasonic nebulizer embodying the present invention.

FIG. 2 illustrates a presently preferred example of an electric circuit in accordance with the present invention. A transistor Tr is self-oscillated, and the transducer 4, such as a piezo-electric vibrator, is excited. Any well-known oscillator circuit may be utilized. In the preferred embodiment of FIG. 2, $C_1$, $C_2$, and $C_3$ are capacitors; $L_1$ and $L_2$ are inductors; $R_1$, $R_2$, and $R_3$ are resistors; D is a diode; REC is a rectifier circuit; A/C is an alternating current power supply. The float switch $5^1$, a two-terminal device, is closed or turned on when liquid is found in the container, and is opened or turned off when no liquid is found in the container. The float switch $5^1$ is installed in a base biasing circuit for the transistor Tr and when the float switch is turned off or is opened, the transistor is biased in such a manner as to terminate the oscillation thereof. VR is a variable resistor which is utilized for adjusting the intensity of oscillation, and controls the base biasing of the transistor to provide a desired nebulizing action.

The circuit components enclosed by dashed line in FIG. 2 constitute an alarm device in accordance with the present invention. The alarm device is constituted by a resistor r, a zener diode ZD, a capacitor C and an alarm indicated in block form such as a lamp or buzzer. As shown in the drawing, the alarm device is connected between one end or terminal 5*a* of the float switch $5^1$ and the common potential E. The zener diode ZD is mainly used for providing a positive switching operation for the alarm.

Figure 3:
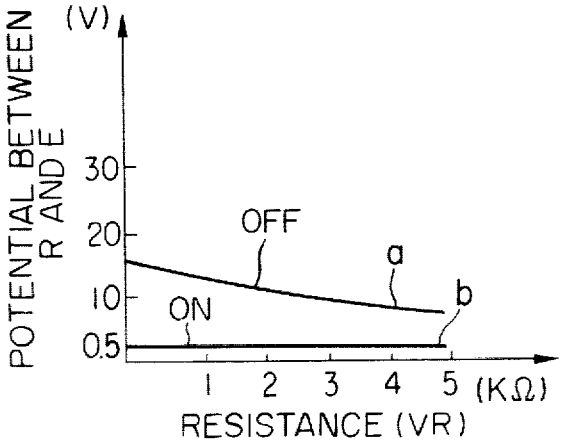
FIG. 3 shows voltage curves applicable to the circuit of FIG. 2.

In the arrangement shown in FIG. 2, the voltage or potential between the points R and E when the float switch $5^1$ is off or opened is illustrated by curve (a) in FIG. 3; the voltage between the points R and E when the float switch $5^1$ is on or closed is illustrated by the curve (b) in FIG. 3. In FIG. 3, the abscissa is the resistance (KΩ) of the variable resistor VR used to adjust the nebulized volume. The curves result from a power supply voltage A/C of 48 volts; $R_1$ corresponds to 3900 ohms; $R_2$ is 5600 ohms; and a maximum value of VR is 5000 ohms.

As apparent from FIG. 3, when water is not present in the container (that is, the float switch $5^1$ is turned off or is opened), the voltage at the point R is about 9 to 15 volts (curve a). On the other hand, the voltage at the point R (when there is water in the container, i.e., the float switch $5^1$ is turned on or is closed) substantially corresponds to 0 volts (curve b), irrespective of the adjustment of resistor VR.

Thus, the alarm device connected to the point R is such that it is operated in a range of 10 to 15 volts for the specific values just described. The operation required is positively performed by arranging the zener diode ZD as shown. That is, a zener diode is utilized having a yielding voltage of about 10 volts. When the float switch $5^1$ is on or closed, a lower voltage is applied to the alarm device, insufficient to activate the alarm. If the float switch is off or open, and regardless of the setting of the variable resistor VR for adjusting the oscillator output, a higher voltage of about 10 volts is applied to the alarm by the zener diode, and the alarm is accordingly operated. Thus, an absence of liquid in the container is displayed by the lamp or buzzer which may be immediately noted by an operator. At the same time, the transistor oscillator terminates its oscillation, and the transducer terminates its nebulizing operation. When an alarm signal is generated, if the operator supplies water to the container, it is possible to provide uniform control over humidity.

As described above, it is possible to add an alarm device to an ultrasonic nebulizer in accordance with the present invention without requiring an additional float switch. It is also possible to provide an easy monitoring of the presence or absence of liquid.

The preferred embodiment described above is obviously subject to being modified. Accordingly, the invention should be taken to be defined by the following claims.

What is claimed is:

1. In a device for sensing an abnormal condition in an ultrasonic nebulizer that includes a container for storing a liquid, a transducer located generally at the bottom of said container to apply an ultrasonic wave to the liquid to nebulize the same, an oscillator for exciting said transducer, a switch whose condition is responsive to the level of the liquid in the container, a circuit coupled to said switch for controlling oscillation in the oscillator in response to the condition of said switch so that oscillation is terminated when the liquid level in the container falls below a predetermined level, and an alarm also coupled to said switch and activated when oscillation is terminated by said circuit, the improvement wherein said switch is a 2-terminal switching device in which the two terminals thereof are connected when said switch is closed and are disconnected when said switch is opened, one of the two switch terminals being coupled to said oscillator and the other switch terminal being coupled to both a source of biasing potential and to said alarm so that, when said switch is closed, said biasing potential is applied to said oscillator and said other switch terminal is concomitantly at a low level potential insufficient to activate said alarm, and when said switch is opened said biasing potential is removed from said oscillator concomitantly to raise the potential of said other switch terminal to a higher level potential sufficient to activate said alarm.

2. A device according to claim 1, wherein a zener diode is coupled to said other switch terminal and has applied thereto said low and higher level potentials, and said alarm is coupled to said zener diode.

3. A device according to claim 1 or 2, wherein a resistor couples said other switch terminal to said source of biasing potential so that, when said switch is closed, the biasing current flow through said resistor to said oscillator results in a sufficient voltage drop across said resistor to result in said low level potential, and so that, when said switch is opened and said biasing current ceases, the voltage drop across said resistor diminishes to result in said higher level potential.

4. A device according to claim 3, wherein said resistor is variable.

* * * * *